US008360553B2

(12) United States Patent
Sakakibara

(10) Patent No.: US 8,360,553 B2
(45) Date of Patent: Jan. 29, 2013

(54) LIQUID DROPLET JETTING APPARATUS

(75) Inventor: Akihiro Sakakibara, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 27 days.

(21) Appl. No.: 13/075,043

(22) Filed: Mar. 29, 2011

(65) Prior Publication Data

US 2011/0310175 A1 Dec. 22, 2011

(30) Foreign Application Priority Data

Jun. 17, 2010 (JP) ..... 2010-138543

(51) Int. Cl.
*B41J 19/00* (2006.01)

(52) U.S. Cl. ..... 347/37; 347/8; 347/32; 400/238; 400/352

(58) Field of Classification Search ..... 347/8, 37, 347/29–32
See application file for complete search history.

(56) References Cited

U.S. PATENT DOCUMENTS 5,710,587 A * 1/1998 Suzuki et al. ..... 347/104
6,042,217 A * 3/2000 Jones ..... 347/32
7,549,714 B2 * 6/2009 Samoto ..... 347/8
8,025,351 B2 * 9/2011 Ishida ..... 347/8
2003/0107610 A1 * 6/2003 Lim ..... 347/8
2005/0196214 A1 * 9/2005 Ishikawa et al. ..... 400/352
2005/0206666 A1 * 9/2005 Takahashi et al. ..... 347/8
2005/0253880 A1 * 11/2005 Nakamura et al. ..... 347/8
2006/0209104 A1 * 9/2006 Naruse ..... 347/8
2007/0070118 A1 * 3/2007 Nakata et al. ..... 347/37

FOREIGN PATENT DOCUMENTS

JP 2001-162076 A 6/2001
JP 2005-246933 A 9/2005

* cited by examiner

*Primary Examiner* — Matthew Luu
*Assistant Examiner* — Lily Kemathe
(74) *Attorney, Agent, or Firm* — Baker Botts L.L.P.

(57) ABSTRACT

A liquid droplet jetting apparatus includes a jetting head having a jetting surface on which a plurality of nozzles are formed for jetting liquid droplets; a carriage carrying the jetting head and moving reciprocatingly in a first direction along a surface parallel to the jetting surface; and a guide member having a guide surface perpendicular to the jetting surface and extending in the first direction to guide the carriage along the guide surface. The carriage is provided with a fixed slide member fixed to the carriage to slide along the guide surface; a movable slide member arranged apart from the fixed slide member in the first direction to slide along the guide surface and configured to be movable with respect to the carriage in a second direction perpendicular to the first direction; and an angle change mechanism for changing an angle of the carriage relative to the first direction.

14 Claims, 10 Drawing Sheets

SECOND DIRECTION
d1
d2
2
34
51
51a
51b
52
53
53a
54
61
62
63
32
32a

SECOND DIRECTION
d1
d2
2
32
32a
34
51
51a
51b
52
53
53a
54
54a
54b
61
62
63

SECOND DIRECTION
d1
d2
2
51
51a
51b
52
53
53a
54
61
71
72
32
32a

LIQUID DROPLET JETTING APPARATUS

CROSS REFERENCE TO RELATED APPLICATION

The present application claims priority from Japanese Patent Application No. 2010-138543, filed on Jun. 17, 2010, the disclosure of which is incorporated herein by reference in its entirety.

BACKGROUND OF THE INVENTION

1. Field of the Invention

The present invention relates to liquid droplet jetting apparatus which jets liquid droplets from a plurality of nozzles.

2. Description of the Related Art

As a liquid droplet jetting apparatus which jets liquid droplets from a plurality of nozzles, image recording apparatus is known. The image recording apparatus performs printing on a recording paper by jetting ink droplets from an ink-jet head installed on a carriage which is guided by a guide member to move reciprocatingly in a predetermined first direction.

Here, the plurality of nozzles formed in the ink jet head generally form a plurality of nozzle rows each extending in a second direction perpendicular to the first direction. However, because errors and the like may occur at the time of installing the ink-jet head onto the carriage, the nozzle rows are sometimes inclined with respect to the second direction. Then, under the condition that the nozzle rows are inclined with respect to the second direction, if ink droplets are jetted with the same timing as applied in the case that the nozzle rows are arranged in the second direction in order to print straight lines extending in the second direction, the landing positions of the ink droplets jetted from the nozzles which are formed on one end side in the extending direction of the nozzle rows and the landing positions of the ink droplets jetted from the nozzles which are formed on the other end side in the extending direction of the nozzle rows will deviate in the first direction each other. As a result, it is not possible to print straight lines extending in the second direction, and thereby the print quality may degrade.

In view of this, the image recording apparatus described in U.S. Patent Application Publication No. 2005/0196214 (corresponding to Japanese Patent Application Laid-Open No. 2005-246933), for example, changes an angle of the carriage to adjust the posture of the carriage so that the nozzle rows may become parallel to the second direction. In this image recording apparatus, a first convex slide portion and a second convex slide portion are provided on the carriage per se, and slide along a slide surface (a guide surface) provided on the guide member to be guided in a scanning direction. Here, the first convex slide portion is fixed to the carriage, whereas the second convex slide portion is movable in the second direction perpendicular to the first direction by virtue of a posture adjustment means. Then, it is possible to change the angle of the carriage relative to the first direction by moving the second convex slide portion by the posture adjustment means and adjusting a positional relationship between the first and second convex slide portions.

The posture adjustment means includes an adjuster block configured integrally with the second convex slide portion, an eccentric round shaft fitted or inserted into the adjuster block such that its outer circumferential surface is in touch with an abutment surface of the adjuster block, a circular dial plate formed integrally with the eccentric round shaft, a plate spring arranged to face the dial plate, and the like. Then, by turning the dial plate to rotate the eccentric round shaft, it is possible to change the position of the outer circumferential surface of the eccentric round shaft and to move the adjuster block in touch with the eccentric round shaft integrally with the second convex slide portion.

Further, a plurality of grooves are formed in the dial plate to align in the circumferential direction, while a projecting press portion is formed in the plate spring to be selectively engageable with any of the plurality of grooves. By virtue of this, it is possible to selectively position the eccentric round shaft formed integrally with the dial plate to any of a plurality of positions associated with the plurality of grooves of the dial plate.

Here, the longer the nozzle rows extend, the more the print quality degrades due to the inclination of the nozzle rows as described hereinabove. That is, in the case of long nozzle rows, even if the nozzle rows are inclined only a little, the landing positions of the ink droplets jetted from the nozzles on one end side in the extending direction of the nozzle rows and the landing positions of the ink droplets jetted from the nozzles on the other end side may greatly deviate each other in the first direction, and thereby the print quality may greatly degrade. Therefore, in such a case, it is necessary to finely adjust the direction of the nozzle rows. Then, in order to finely adjust the direction of the nozzle rows with the posture adjustment means described in U.S. Patent Application Publication No. 2005/0196214, it is necessary to form more grooves in the dial plate, or to reduce the eccentricity of the eccentric round shaft.

However, because the dial plate is a small component, it is difficult to increase the number of the grooves formed in the dial plate. Further, if the dial plate is enlarged to allow more grooves to be formed, the entire apparatus is also bound to increase in size. On the other hand, reducing the eccentricity of the eccentric round shaft narrows the movable range of the adjuster block (the second convex slide portion). Thereby, when the nozzle rows are greatly inclined, it may become impossible to adjust the direction of the nozzle rows.

SUMMARY OF THE INVENTION

Accordingly, an object of the present invention is to provide a liquid droplet jetting apparatus capable of finely adjusting an angle of the carriage and sufficiently securing an adjustable range for the angle as well.

According to an aspect of the present invention, there is provided a liquid droplet jetting apparatus which jets liquid droplets, the apparatus including: a liquid droplet jetting head which has a jetting surface in which a plurality of nozzles for jetting the liquid droplets are formed; a carriage on which the liquid droplet jetting head is installed and which reciprocatingly moves in a first direction along a surface parallel to the jetting surface; and a guide member which has a guide surface perpendicular to the jetting surface and extending in the first direction and which guides the carriage along the guide surface, and the carriage is provided with a fixed slide member which is fixed to the carriage and slides along the guide surface, a movable slide member which is arranged apart from the fixed slide member in the first direction and slides along the guide surface and configured to be movable with respect to the carriage in a second direction perpendicular to the first direction, and an angle change mechanism for changing an angle of the carriage with respect to the first direction by moving the movable slide member in the second direction and adjusting a positional relationship between the fixed slide member and the movable slide member, and the angle change mechanism has an inner eccentric cam and an outer eccentric cam rotatable around a rotation shaft extending in a direction perpendicular to the second direction, and a rotation stop member intervening between the inner eccentric cam and the outer eccentric cam to prevent one of the inner eccentric cam and the outer eccentric cam from being rotated along with a rotation of the other of the inner eccentric cam and the outer eccentric cam.

According to the aspect of the present invention, if the eccentricities of the eccentric cams are reduced, it is possible to finely adjust the position of the movable slide member in the second direction, that is, to finely adjust the angle of the carriage relative to the first direction. Further, because it is possible to move the movable slide member by individually rotating the inner eccentric cam and the outer eccentric cam, even though the eccentricities of the eccentric cams are reduced, it is still possible to sufficiently secure a movable range for the movable slide member.

DESCRIPTION OF THE PREFERRED EMBODIMENT

Hereinbelow, explanations will be made with respect to a preferred embodiment of the present invention.

Figure 1:
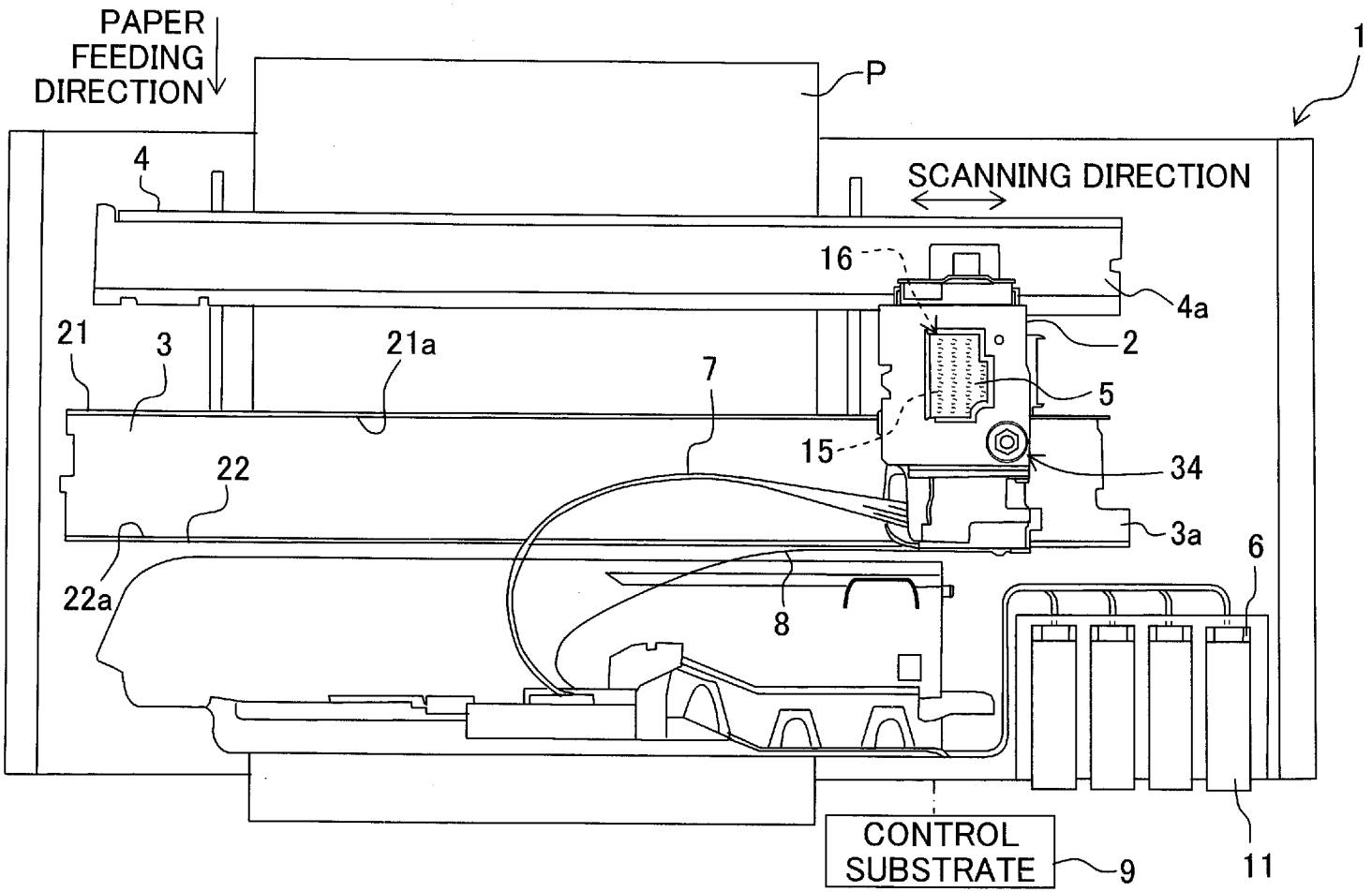
FIG. 1 is a schematic configuration diagram of a printer as an example of the liquid droplet jetting apparatus in accordance with an embodiment of the present invention.

As shown in FIG. 1, a printer 1 (liquid droplet jetting apparatus) includes a carriage 2, two guide rails 3 and 4, an ink jet head 5, four cartridge installation portions 6, four tubes 7, an FFC 8 (Flexible Flat Cable), a control substrate 9, and the like.

The carriage 2 moves in a reciprocating manner along the two guide rails 3 and 4 in a horizontal scanning direction (a leftward and rightward direction of FIG. 1: a first direction). Further, the carriage 2 is able to change its angle relative to the scanning direction. Furthermore, detailed explanations will be made hereinafter with respect to the movement of the carriage 2 along the guide rails 3 and 4, and the change of the angle of the carriage 2.

The ink jet head 5 is installed on the lower surface of the carriage 2. The lower surface of the ink-jet head 5 is a planar jetting surface 5*a* (see FIG. 3) in which a plurality of nozzles 15 are formed to form four nozzle rows 16 each of which extends in a paper feeding direction perpendicular to the scanning direction (downward in FIG. 1) and which are aligned in the scanning direction. Then, from those plurality of nozzles 15, ink droplets of black, yellow, cyan and magenta are jetted in the order of the nozzle rows 16 from the left side of FIG. 1.

The four cartridge installation portions 6 serve to install ink cartridges 11, and are aligned in the scanning direction. Then, in these four cartridge installation portions 6, the ink cartridges 11 are installed to store inks of black, yellow, cyan and magenta respectively in arrangement order from the left side of FIG. 1.

Figure 2:
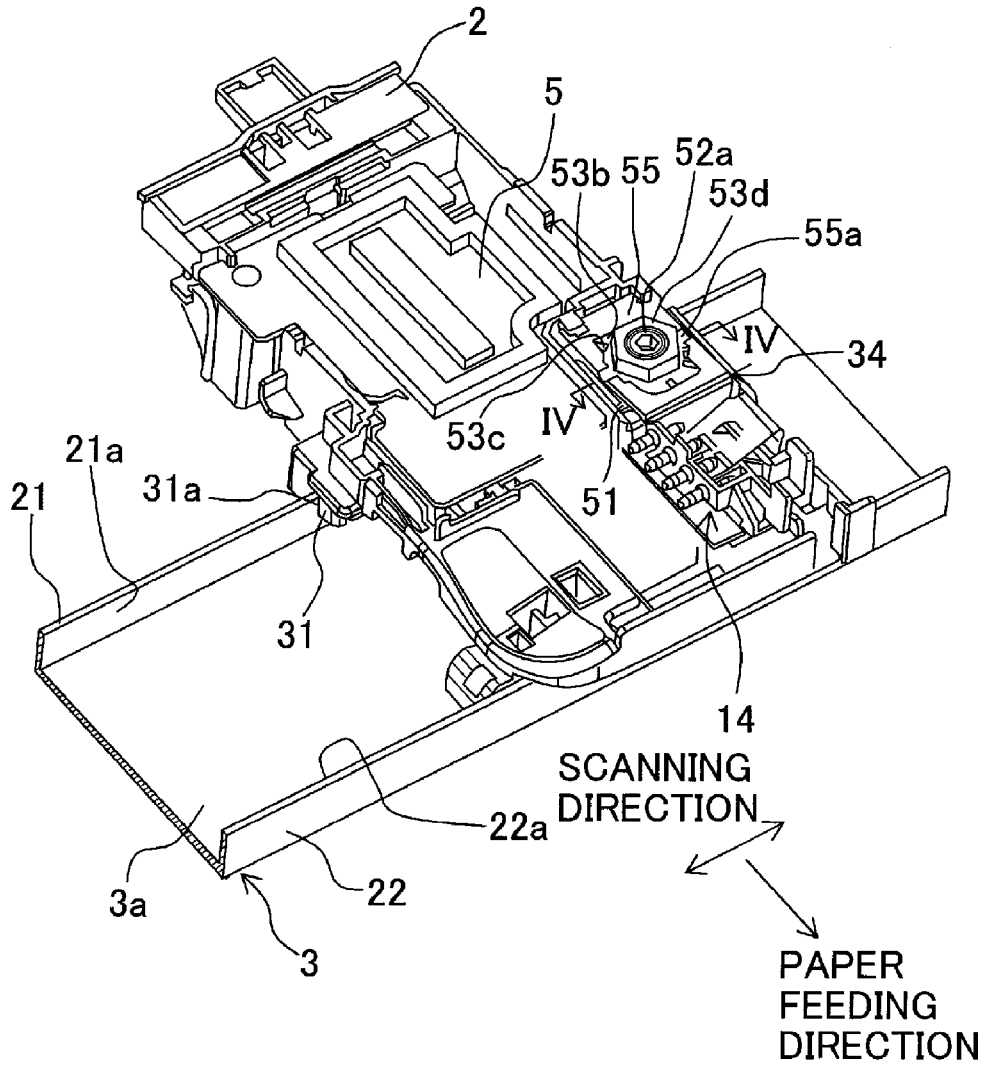
FIG. 2 is a perspective view of a portion in the vicinity of a carriage of the printer of FIG. 1.

The four tubes 7 connect the ink-jet head 5 (in a precise sense, sub-tanks 14 connected to the ink-jet head 5; see FIG. 2) with the four cartridge installation portions 6 to supply the inks from the ink cartridges 11 installed in the four cartridge installation portions 6 to the ink-jet head 5.

The FFC 8 extends in parallel with the tubes 7 and electrically connects the ink-jet head 5 with the control substrate 9 with wires (not shown) formed on its surface. The control substrate 9 supplies power to the ink jet head 5, and outputs signals for controlling the ink-jet head 5.

Then, the printer 1 carries out printing on a recording paper P by jetting ink droplets from the ink jet head 5 reciprocatingly moving in the scanning direction along with the carriage 2 to the recording paper P transported by a paper transport mechanism (not shown) in the paper feeding direction.

Next, FIGS. 1 to 6C will be utilized to elaborate the carriage 2 and the guide rails 3 and 4 for guiding the carriage 2. However, in FIG. 2, the carriage 2 is shown in a state of having removed the cover arranged over its upper surface. Further, in FIGS. 4 to 6C, in order to facilitate easiness to understand the eccentric state of eccentric cams 52 and 53 (an inner eccentric cam and an outer eccentric cam) which will be described hereinafter, and the movement of a slider 51 which will also be described hereinafter, the eccentricity of the eccentric cams 52 and 53 is greater in illustration than it is in reality. In accordance with this, changes are also made as appropriate to the size and the like with respect to other configurations such as the width of a groove 63 which will also be described hereinafter, etc. Further, in FIGS. 6A to 6C, the position of the eccentric cam 53 is indicated with the long dashed double-dotted line.

The guide rail 3 is a plate-like member of an approximately rectangular shape elongated in the scanning direction and, on both end portions thereof in the paper feeding direction, projecting portions 21 and 22 are respectively formed to project upward and extend almost the entire length of the guide rail 3 in the scanning direction. Then, the surfaces of the projecting portion 21 and projecting portion 22 facing each other, that is, the lower surface of the projecting portion 21 in FIG. 1 and the upper surface of the projecting portion 22 in FIG. 1, are provided as guide surfaces 21*a* and 22*a* extending in the scanning direction and perpendicular to the jetting surface 5*a*, respectively. Further, in the embodiment, the guide rail 3 corresponds to the guide member in accordance with the present invention, and the guide surface 21*a* corresponds to the guide surface in accordance with the present invention. Further, another guide surface 3*a* is defined as the upper surface of the end portion of the guide rail 3 on the far side from the guide rail 4 (the lower side in FIG. 1).

The guide rail 4 is another plate-like member of an approximately rectangular shape elongated in the scanning direction, and a guide surface 4*a* is defined as the upper surface of its end portion on the near side to the guide rail 3 (the lower side in FIG. 1) in the paper feeding direction.

In addition to the ink-jet head 5 described hereinabove, the carriage 2 is also provided with a fixed slide member 31, a movable slide member 32, two biasing mechanisms 33, an angle change mechanism 34, and the like.

The fixed slide member 31 is provided in one end portion of the carriage 2 in the scanning direction (the end portion on the right side of FIG. 3) in the approximately central portion in the paper feeding direction, and fixed to the carriage 2. Being viewed from the scanning direction, the fixed slide member 31 is arranged to sandwich the projecting portion 21, and the surface facing the guide surface 21*a* is defined as a slide surface 31*a* (a first slide surface).

The movable slide member 32 is provided in the other end portion of the carriage 2 on the opposite side to the fixed slide member 31 in the scanning direction (the end portion on the left side of FIG. 3) in the approximately central portion in the paper feeding direction. That is, the movable slide member 32 is arranged to be spaced apart from the fixed slide member 31 in the scanning direction.

Being viewed from the scanning direction, the movable slide member 32 is, in the same manner as the fixed slide member 31, arranged to sandwich the projecting portion 21, and the surface facing the guide surface 21*a* is defined as a slide surface 32*a* (a second slide surface). Further, the movable slide member 32 is, different from the fixed slide member 31, not fixed to the carriage 2 but movable in a direction perpendicular to the slide surface 32*a* (a second direction) with respect to the carriage 2. Further, the second direction is parallel to the paper feeding direction in a state before inclining the carriage 2 with respect to the scanning direction as will be described hereinafter, but inclined with respect to the paper feeding direction in a state of having inclined the carriage 2 with respect to the scanning direction.

Figure 3:
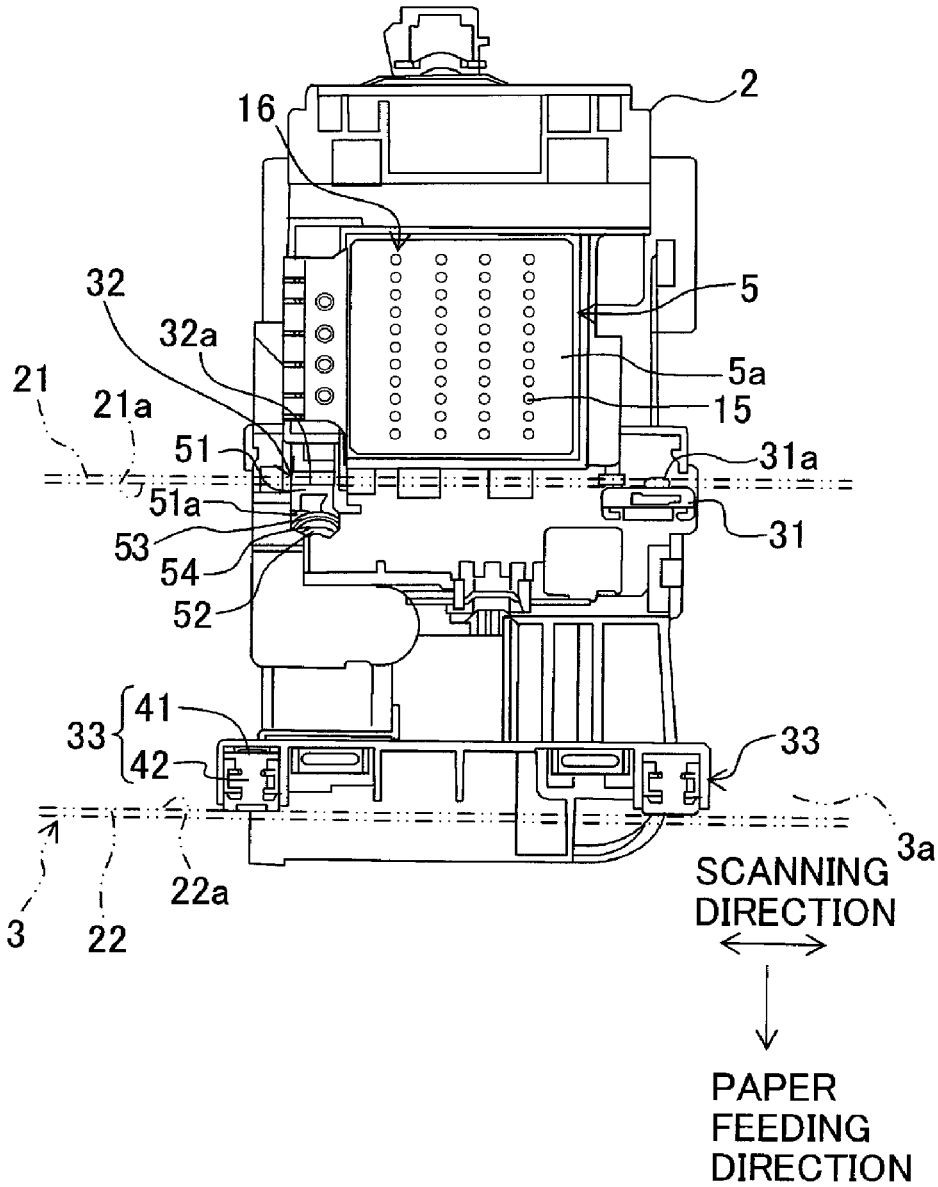
FIG. 3 is a plan view viewing the carriage from below.
Figure 4:
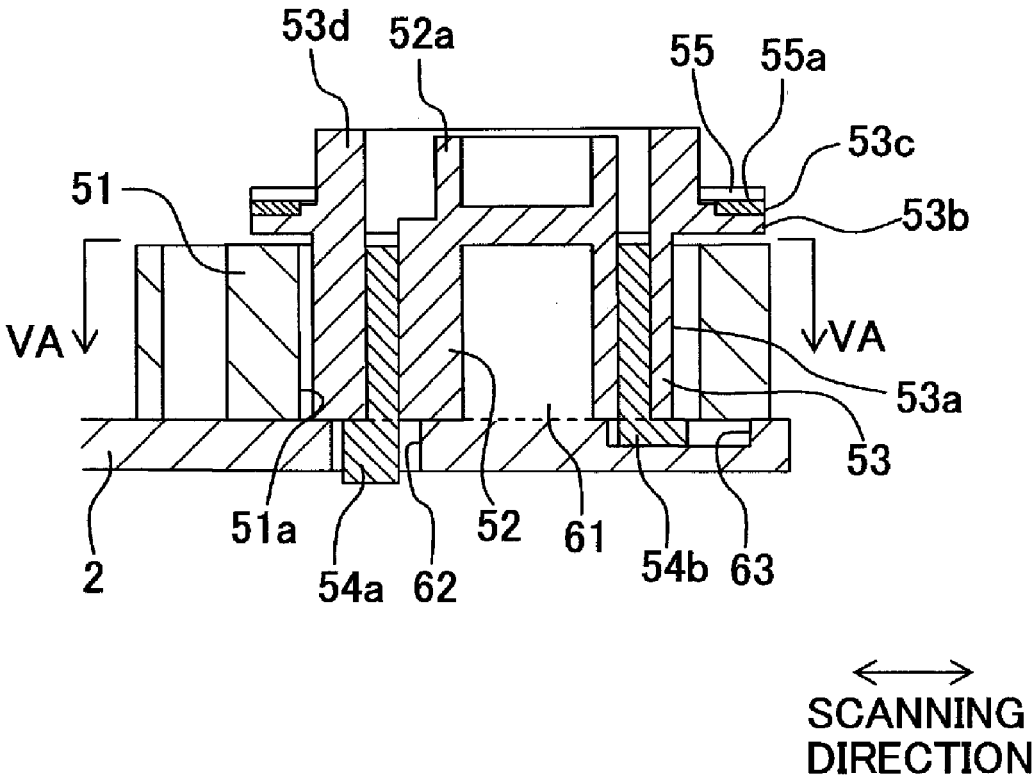
FIG. 4 is a cross-sectional view taken along the line IV-IV of FIG. 2.

The two biasing mechanisms 33 are provided respectively on both end portions of the carriage 2 in the scanning direction along the end portion on the lower side in FIG. 3 to face the slide surface 22*a* and intervene between the carriage 2 and the slide surface 22*a* (the guide rail 3). The biasing mechanisms 33 are constructed by a spring 41 fixed to the carriage 2 and a pressing member 42 pressed against the slide surface 22*a* by the spring 41. Then, the carriage 2 is biased toward the guide surface 21 a side by the force of pressing the pressing members 42 back from the slide surface 22*a*. By virtue of this, the slide surfaces 31*a* and 32*a* are pressed against the guide surface 21*a*.

Then, having such a construction as described hereinabove, the carriage 2 is guided in the scanning direction in motion by the sliding of the slide surfaces 31*a* and 32*a* along the guide surface 21*a*, the sliding of the pressing members 42 along the slide surface 22*a*, the sliding of the lower surface of the end portion on the upstream side in the paper feeding direction (the upper side in FIG. 1) along the guide surface 4*a*, and the sliding of the lower surface of the other end portion on the downstream side in the paper feeding direction (the lower side in FIG. 1) along the guide surface 3*a*.

In order to change the angle of the carriage 2 relative to the scanning direction, the angle change mechanism 34 changes the position of the movable slide member 32 in the second direction to adjust a positional relationship between the slide surface 31*a* and the slide surface 32*a*. The angle change mechanism 34 includes the slider 51, the two nested eccentric cams 52 and 53, a rotation stop member 54 intervening between the eccentric cams 52 and 53, a plate spring 55, and the like.

Figures 5A, 5B, 5C:
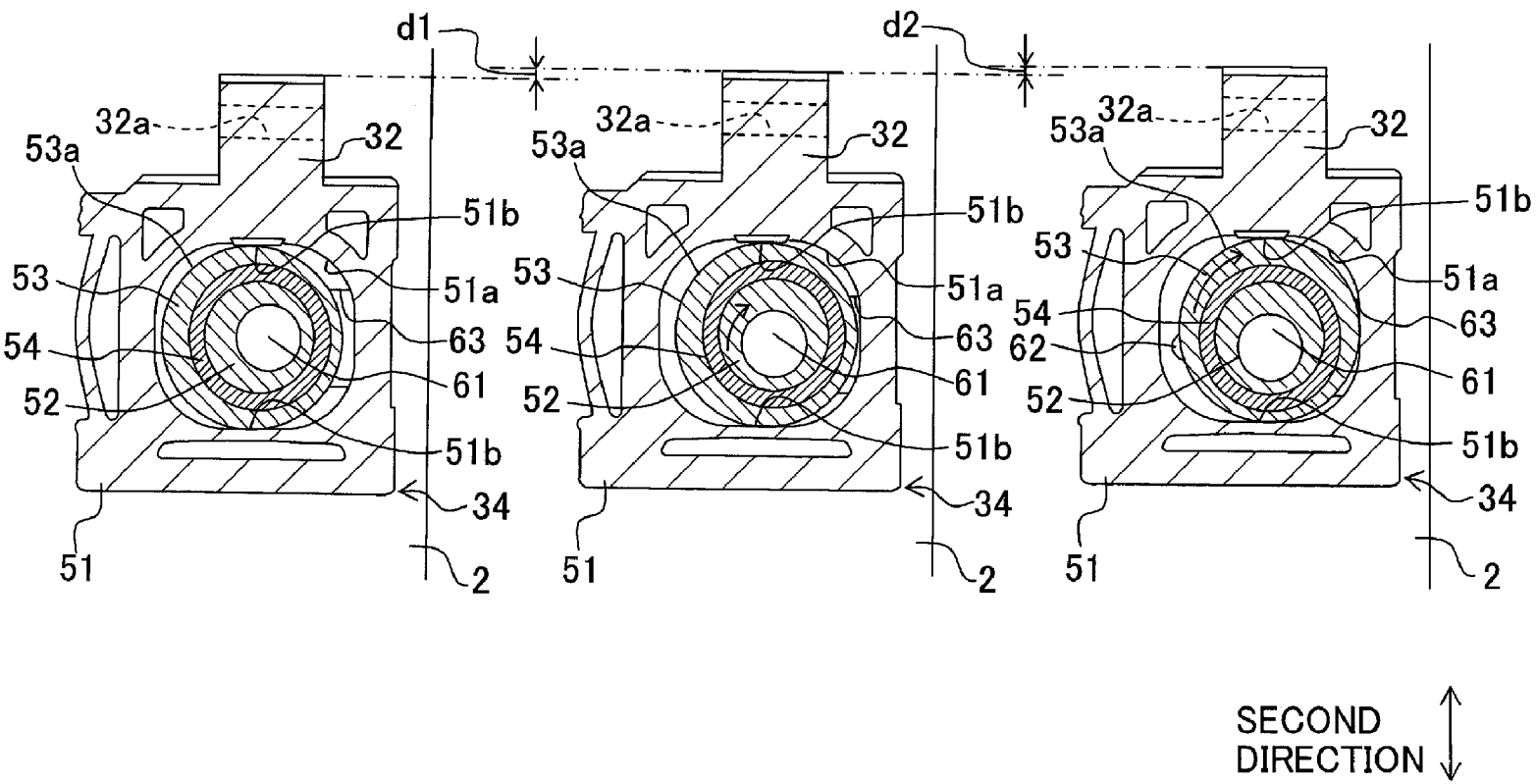
FIG. 5A is a cross-sectional view taken along the line VA-VA of FIG. 4, and FIGS. 5B and 5C are views showing states of eccentric cams of FIG. 5A after being rotated.

The slider 51 (movement member) is formed integrally with the movable slide member 32 (coupled with the movable slide member 32), and movable along with the movable slide member 32 in the second direction. Further, in the approximately central portion of the slider 51, a through hole 51*a* is formed to accommodate the eccentric cams 52 and 53, and the rotation stop member 54. As shown in FIGS. 5A to 5C, each of outer circumferential of the inner eccentric cum 52, inner circumferential of the outer eccentric cum 53, and outer circumferential and inner circumferential of the rotation stop member 54 has a circular shape.

The eccentric cam 52 is rotatable around a rotation shaft 61 which is provided in the carriage 2 and extends in a vertical direction to be inserted through the eccentric cam 52. Further, the carriage 2 is provided with a stopper or the like and, from the state shown in FIG. 5A, the eccentric cam 52 is 90-degree rotatable in a clockwise direction and in a counterclockwise direction, respectively.

Further, an operation portion 52*a* is provided on the upper end portion of the eccentric cam 52. It is possible to insert a driver or the like into the operation portion 52*a* from above and utilize the driver or the like to rotate the operation portion 52*a* so as to rotate the eccentric cam 52 in the aftermentioned case of adjusting the angle of the carriage 2.

The eccentric cam 53 is rotatable around the center of the rotation stop member 54 as the axis. That is, the central axis of the rotation stop member 54 extending in a vertical direction serves as the rotational axis of the eccentric cam 53. Further, the through hole 51*a* formed in the slider 51 is almost as long as the diameter of the outer eccentric cam 53 in the second direction, and both end portions of an outer circumferential surface 53*a* of the eccentric cam 53 in the second direction are in contact with contact surfaces 51*b* which are wall surfaces defining both end potions of the through hole 51*a* in the second direction.

Further, in the embodiment, the biasing mechanisms 33 press the slide surface 32*a* against the guide surface 21*a*. Thereby, the slide surface 32*a* is pressed back from the guide surface 21*a* to cause the contact surface 51*b* on the upper side in FIGS. 5A to 5C of the slider 51 which is formed integrally with the movable slide member 32 to be pressed against the outer circumferential surface 53*a* of the eccentric cam 53.

Further, a disciform dial portion 53*b* is formed on the upper end portion of the eccentric cam 53. In the dial portion 53*b*, a plurality of grooves 53*c* (positioning mechanism) are formed to align along the outer circumference. Here, these plurality of grooves 53*c* are formed at symmetrical positions with respect to the center of the dial portion 53*b*.

Further, an operation portion 53*d* is provided on the upper surface in the approximately central portion of the dial portion 53*b*. Then, in the aftermentioned case of adjusting the angle of the carriage 2, the eccentric cam 53 is rotated by rotating the operation portion 53*d*.

The cylindrical rotation stop member 54 intervenes between the two eccentric cams 52 and 53 to prevent one of the eccentric cams 52 and 53 from rotating along with a rotation of the other in rotation at the time of rotating the one eccentric cam. That is, because the rotation stop member 54 stands between the eccentric cams 52 and 53, it is possible to individually rotate the eccentric cams 52 and 53.

Further, on one end portion of the rotation stop member 54 in a direction perpendicular to the second direction (on the left side of FIG. 4), an approximately cylindrical shaft portion 54*a* is provided to project from the lower surface to the lower side through a through hole 62 (an accommodation portion) formed in the carriage 2. By virtue of this, the rotation stop member 54 is able to swing around the shaft portion 54*a*. Here, the through hole 62 is almost as long as the diameter of the shaft portion 54*a* in the second direction and, meanwhile, longer than the diameter of the shaft portion 54*a* in a direction parallel to the slide surface 32*a*.

Further, a rotation restriction portion 54*b* is formed on the other end portion of the rotation stop member 54 (on the right side of FIG. 4) on the opposite side to the shaft portion 54*a* across the eccentric cam 52. The rotation restriction portion 54*b* is fitted or inserted into the groove 63 formed in the carriage 2. Here, the groove 63 is longer than the rotation restriction portion 54*b* in the second direction, and thus the rotation stop member 54 is able to swing within the range in which the rotation restriction portion 54*b* is movable inside the groove 63. That is, when the rotation restriction portion 54*b* comes in contact with the wall surface of the groove 63, the movement is restricted in the second direction.

The plate spring 55 is arranged on the upper side of the dial portion 53*b* of the eccentric cam 53 and fixed to the carriage 2. Further, the plate spring 55 is provided with two projections 55*a* (positioning mechanism) formed by being flexed at the positions opposite to each other across the operation portion 53*d*. The two projections 55*a* are selectively engageable with any two of the plurality of grooves 53*c* at symmetrical positions with respect to the central axis of the dial portion 53*b*. By virtue of this, the eccentric cam 53 can be selectively positioned to any of the plurality of positions associated with the plurality of grooves 53*c*. Further, in the embodiment, the combination of the plurality of grooves 53*c* provided in the dial portion 53*b* and the projections 55*a* provided on the plate spring 55 corresponds to the positioning mechanism in accordance with the present invention.

Next, referring to FIGS. 5A to 7C, explanations will be made with respect to a method for changing the angle of the carriage 2 relative to the scanning direction by moving the movable slide member 32 with the angle change mechanism 34.

Figures 6A, 6B, 6C:
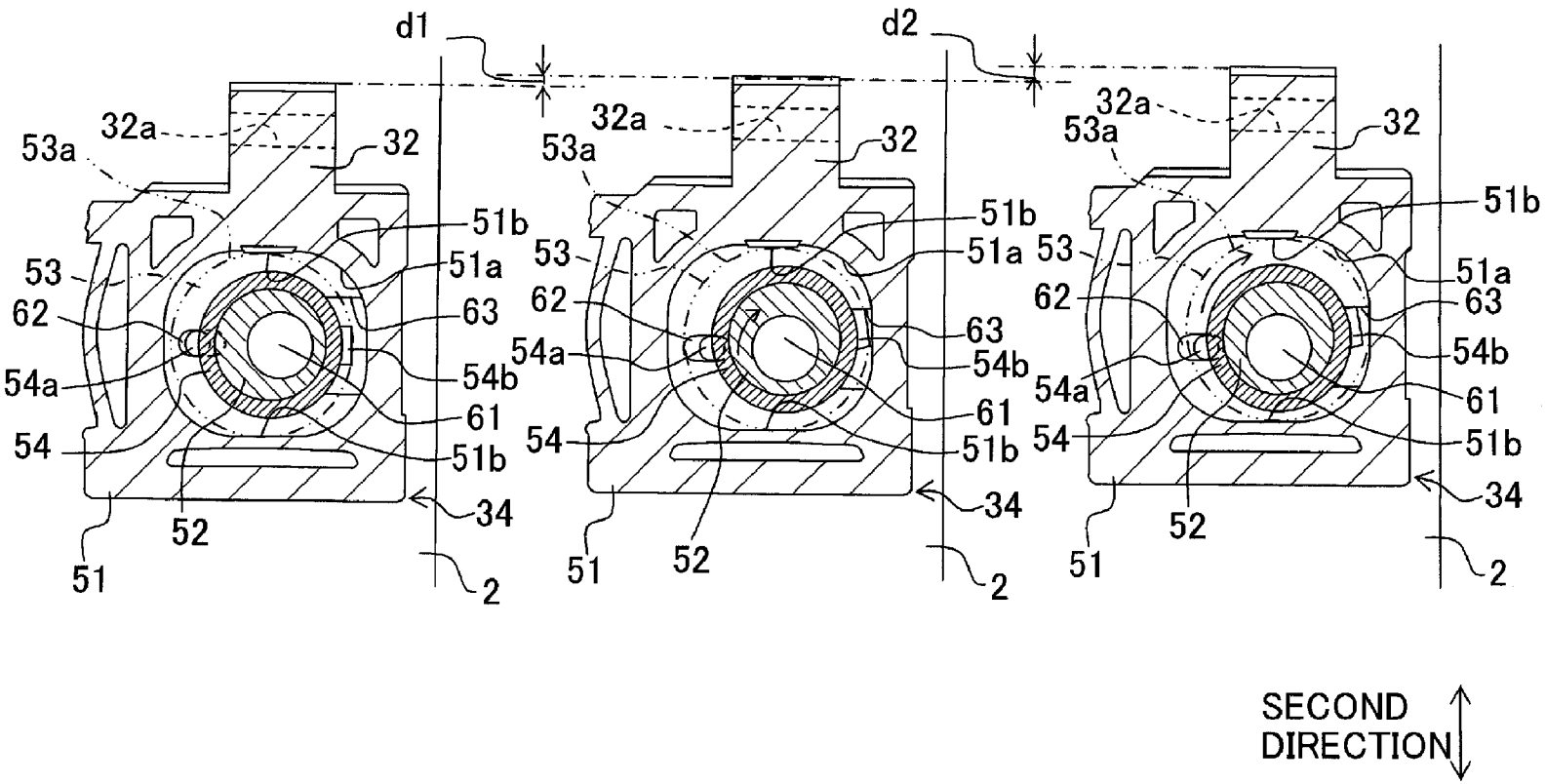
FIGS. 6A to 6C are views having removed an outer eccentric cam, corresponding to FIGS. 5A to 5C respectively.

Here, in a state before adjusting the angle of the carriage 2, as shown in FIGS. 5A and 6A for example, the widest portions of the eccentric cams 52 and 53 come to the end on the same side in a direction perpendicular to the second direction (the left end of FIGS. 5A and 6A).

In this state, if the inner eccentric cam 52 is rotated in a clockwise direction in FIGS. 5A and 6A, as shown in FIGS. 5B and 6B, the widest portion of the eccentric cam 52 moves to the side of the movable slide member 32 in the second direction (the upper side of FIGS. 5B and 6B). By virtue of this, the rotation stop member 54 and the eccentric cam 53 are pressed by the eccentric cam 52 to move to the upper side of FIGS. 5B and 6B and, at the same time, the slider 51 is pressed by the eccentric cam 53 to move integrally with the movable slide member 32 to the upper side of FIGS. 5B and 6B.

Then, as shown in FIGS. 5B and 6B, when the widest portion of the eccentric cam 52 has come to the end on the side of the movable slide member 32 in the second direction (the upper end of FIGS. 5B and 6B), the moving amount of the slider 51 and movable slide member 32 becomes the maximum, and d1 represents the moving amount of the movable slide member 32 at this stage.

At the time, the rotation stop member 54 swings around the shaft portion 54*a*. Because the shaft portion 54*a* has an approximately cylindrical shape, even though the rotation stop member 54 swings, the length of the shaft portion 54*a* does not change in the second direction. Further, because the through hole 62 into which the shaft portion 54*a* is inserted is configured to be almost as long as the diameter of the shaft portion 54*a* in the second direction, it is possible to configure such that the rotation stop member 54 may swing around the shaft portion 54*a*.

Further, when the eccentric cam 52 is rotated, the rotation stop member 54 and the eccentric cam 53 also move in a direction perpendicular to the second direction. However, in the embodiment, because the through hole 62 is configured to be longer than the shaft portion 54*a* in the direction perpendicular to the second direction, the rotation stop member 54 is allowed to move in the direction perpendicular to the second direction.

Further, the rotation stop member 54 is provided with the rotation restriction portion 54*b* on the end portion opposite to the shaft portion 54*a*. Accordingly, at the time of rotating the eccentric cam 52, even though a great force is acting on the eccentric cams 52 and 53, and the rotation stop member 54 due to application of an external force in a horizontal direction to a driver inserted in the operation portion 52*a*, etc., for example, the rotation restriction portion 54*b* restrains itself from further moving in the second direction from the position in contact with the wall surface of the groove 63. Therefore, at the time of rotating the eccentric cam 52, even though a great force is acting on the rotation stop member 54, it is possible to prevent the shaft portion 54*a* from slipping out of the through hole 62, and to prevent the rotation stop member 54 from being damaged.

Further, in a state of the rotation restriction portion 54*b* being in contact with the wall surface of the groove 63, the external force acting on the rotation stop member 54 is received in both the shaft portion 54*a* and the rotation restriction portion 54*b* which are arranged to be opposite to each other across the eccentric cam 52. Therefore, the external force acting on the rotation stop member 54 is not concentrated at one place, thereby further restraining the shaft portion 54*a* from slipping out and the rotation stop member 54 from being damaged.

Further, from this state, if the outer eccentric cam 53 is rotated in a clockwise direction in FIGS. 5B and 6B, as shown in FIGS. 5C and 6C, the widest portion of the eccentric cam 53 moves to the side of the movable slide member 32 in the second direction (the upper side of FIGS. 5C and 6C). By virtue of this, the slider 51 is pressed by the eccentric cam 53 to move integrally with the movable slide member 32 to the upper side of FIGS. 5C and 6C.

Then, as shown in FIGS. 5C and 6C, when the widest portion of the eccentric cam 53 has come to the end on the side of the movable slide member 32 in the second direction (the upper end of FIGS. 5C and 6C), the moving amount of the slider 51 and movable slide member 32 becomes the maximum, and d2 represents the moving amount of the movable slide member 32 at this stage.

Further, the explanation is made here with respect to the case of rotating the eccentric cam 52 first and then further rotating the eccentric cam 53. However, it is also possible, of course, to move the slider 51 and movable slide member 32 to the upper side of FIGS. 5A and 6A by rotating the eccentric cam 53 in the state of FIGS. 5A and 6A, and then further rotating the eccentric cam 52.

Further, although illustrations are omitted, in an opposite manner to that of the above description, when the eccentric cams 52 and 53 are rotated in a counterclockwise direction in FIGS. 5A to 6C, the widest portions of the eccentric cams 52 and 53 move to the opposite side to the movable slide member 32 in the second direction (the lower side of FIGS. 5A to 6C). By virtue of this, the slider 51 moves integrally with the movable slide member 32 to the lower side of FIGS. 5A to 6C.

Further, because the rotational axis of the eccentric cams 52 and 53 extends in a vertical direction, at the time of rotating the eccentric cams 52 and 53, it is possible to operate the operation portions 52*a* and 53*d* by inserting a driver or the like into the operation portion 52*a* from above, gripping the operation portion 53*d* from above, or the like. Therefore, at the time of adjusting the position of the movable slide member 32, the guide rail 3 will not come in the way.

Then, if the movable slide member 32 is moved as described hereinabove, the positional relationship changes between the slide surface 31*a* of the fixed slide member 31 and the slide surface 32*a* of the movable slide member 32 in the second direction, and thereby the carriage 2 is inclined with respect to the scanning direction such that the slide surfaces 31*a* and 32*a* may come onto the guide surface 21*a* of the guide rail 3, that is, come to the same position in the paper feeding direction.

Figure 7A:
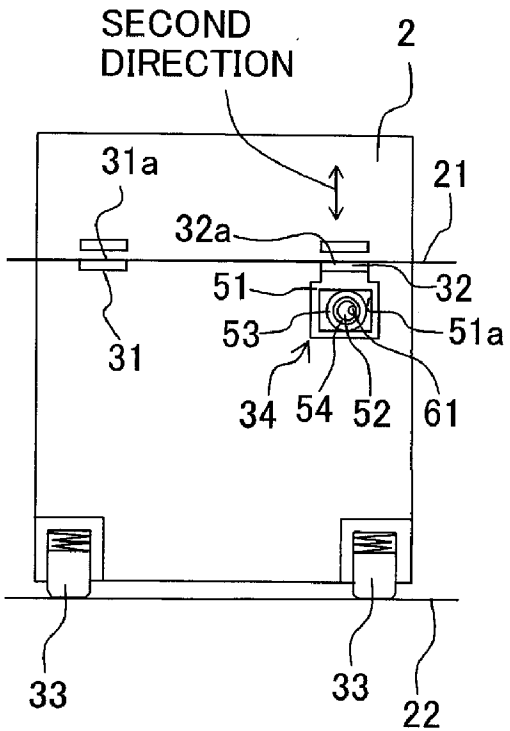
FIGS. 7A to 7C are views schematically showing states of the carriage at the time of moving a movable slide member.
Figure 7B:
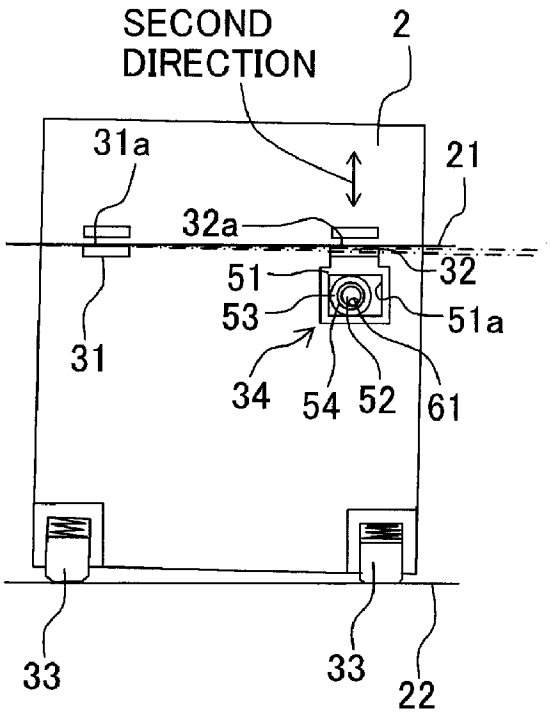
Figure 7C:
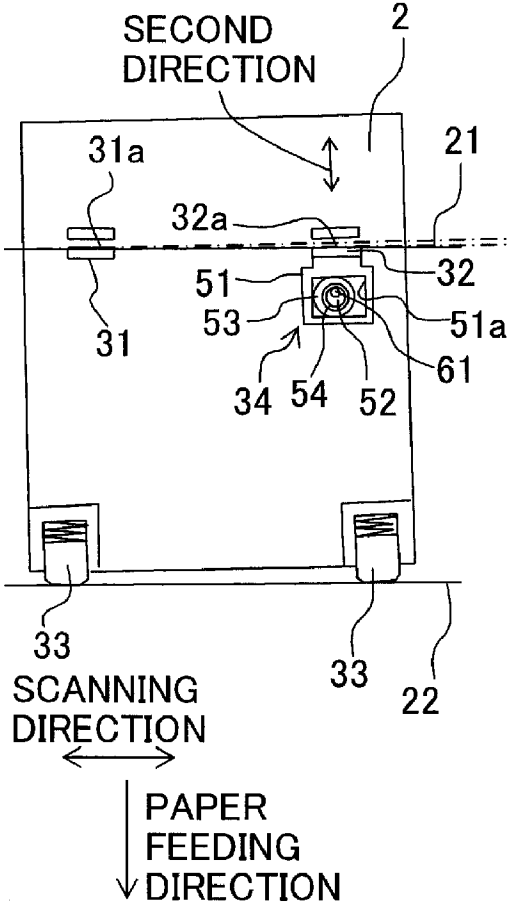

To explain it specifically, in comparison with the posture as shown in FIG. 7A in a state before moving the movable slide member 32, when the movable slide member 32 is moved to the upper side in FIGS. 5A to 6C, the carriage 2 is inclined such as shown in FIG. 7B that the more the portion is on the left side, the more it may come to the upper side. On the other hand, in an opposite manner to this, when the movable slide member 32 is moved to the lower side in FIGS. 5A to 6C, the carriage 2 is inclined such as shown in FIG. 7C that the more the portion is on the right side, the more it may come to the upper side.

As described hereinbefore, because the carriage 2 is provided with the biasing mechanisms 33 and biased by the biasing mechanisms 33 to press the slide surfaces 31*a* and 32*a* against the guide surface 21*a*, it is possible to assuredly change the angle of the carriage 2 by moving the movable slide member 32.

Due to errors and the like in installing the ink-jet head 5 onto the carriage 2, the nozzle rows 16 may sometimes get inclined with respect to the paper feeding direction. Then, if the nozzle rows 16 are inclined with respect to the paper feeding direction, ink droplets may land at positions off the scanning direction, thereby lowering the print quality.

Further, when the nozzle rows 16 are long, even if the nozzle rows 16 are inclined only a little with respect to the paper feeding direction, a great declination may occur between the landing positions of the ink droplets jetted from the nozzles on one side of the nozzle rows 16 and from those on the other side in the paper feeding direction, thereby greatly lowering the print quality.

However, in the embodiment, because it is possible to change the angle of the carriage 2 relative to the scanning direction as described hereinbefore, it is possible to prevent the print quality from being lowered in this manner by inclining the carriage 2 to make the nozzle rows 16 become parallel to the paper feeding direction.

Further, in the embodiment, it is possible to selectively position the eccentric cam 52 to any of the position shown in FIG. 5A and the position after turning 90-degree therefrom clockwise or counterclockwise. On the other hand, it is possible to selectively position the eccentric cam 53 to any of the plurality of positions associated with the plurality of grooves 53*c*. That is, it is not possible to position either of the eccentric cams 52 and 53 to any positions between those positions.

However, even in such cases, by reducing the eccentricity of the eccentric cams 52 and 53 to diminish the size of the grooves 53*c*, etc., it is still possible to finely adjust the position of the movable slide member 32 even if the distances between the plurality of positions corresponding to the grooves 53*c* are not shortened. Therefore, even if the nozzle rows 16 are long, it is still possible to adjust the direction of the nozzle rows 16 to the paper feeding direction to a high accuracy, and thereby it is possible to reliably prevent the print quality from being lowered.

Further, if the eccentricity of the eccentric cams 52 and 53 is reduced, at the time of rotating either of the eccentric cams 52 and 53 alone, the movable slide member 32 may only obtain a small moving amount. However, in the embodiment, because it is possible to move the movable slide member 32 by individually rotating the two eccentric cams 52 and 53, the movement range of the movable slide member 32 is the combination of that by rotating the eccentric cam 52 alone and that by rotating the eccentric cam 53 alone. Therefore, even though the eccentric cams 52 and 53 have a low eccentricity, it is still possible to secure a sufficient movement range for the movable slide member 32. Further, by configuring one eccentric cam with a high eccentricity and the other eccentric cam with a low eccentricity, it is possible to carry out the adjustment to a great extent with the one eccentric cam and to a small extent with the other eccentric cam.

Next, explanations will be made with respect to a few modifications which apply various changes to the embodiment. However, it should be appreciated that explanations will be omitted as appropriate with respect to similar configurations to those of the embodiment.

In the above embodiment, the shaft portion 54*a* is provided on the rotation stop member 54 and, meanwhile, the groove 63 is formed in the carriage 2 for the rotation restriction portion 54*b* to fit in. Then, the rotation restriction portion 54*b* restricts the rotation of the rotation stop member 54 by contact with the wall surface of the groove 63. However, the swing of the rotation stop member 54 may also be restricted by forming a groove in the rotation stop member 54 and, meanwhile, providing a rotation restriction portion on the carriage 2 to be fitted or inserted into the groove formed in the rotation stop member 54, so that the wall surface of the groove of the rotation stop member 54 may come in contact with the rotation restriction portion of the carriage 2.

Further, it is also possible to leave out the configurations such as the rotation restriction portion 54*b* and the like for restricting the rotation range of the rotation stop member 54. The rotation restriction portion 54*b* and the like are provided to prevent the rotation stop member 54 from excessively swinging in case a great force is acting on the eccentric cam 52 to cause the shaft portion 54*a* to slip out and bring damage to the rotation stop member 54 at the time of rotating the eccentric cam 52. Accordingly, the rotation of the shaft portion 54*a* is not an indispensable configuration for restriction. Therefore, without those configurations, in the same manner as described hereinbefore, it is still possible to move the movable slide member 32 in the second direction by rotating the eccentric cams 52 and 53.

Further, in the above embodiment, the through hole 62 is almost as long as the diameter of the shaft portion 54*a* in the second direction and, meanwhile, longer than the diameter of the shaft portion 54*a* in a direction parallel to the slide surface 32*a*. However, it is not limited to this. For example, the through hole may also be shaped such that it is longer than the diameter of the shaft portion 54*a* in the second direction and as long as the diameter of the shaft portion 54*a* in a direction perpendicular to the second direction. In addition to this, the through hole may also extend from the position of the shaft portion 54*a* shown in FIG. 6A in an upward direction, a downward direction, a leftward direction and the like of FIG. 6A.

Further, in the above embodiment, the shaft portion 54*a* of the rotation stop member 54 is configured to be in an approximately cylindrical shape. However, the shaft portion 54*a* is not limited to this shape but may also be in other shapes such as elliptical cylinders, polygonal columns, and the like.

However, in these cases, because the length of the shaft portion in the second direction varies with the rotation of the shaft portion, the through hole through which the shaft portion is inserted should be longer than the shaft portion in the second direction to allow the shaft portion to rotate. Therefore, in comparison with the above embodiment, backlash is more likely to occur in the rotation stop member 54.

Further, in the above embodiment, the rotation stop member 54 is able to swing around the shaft portion 54*a*, and thereby movable in the second direction. However, the configuration is not limited to this for the rotation stop member 54 to be movable in the second direction.

Figures 8A, 8B, 8C:
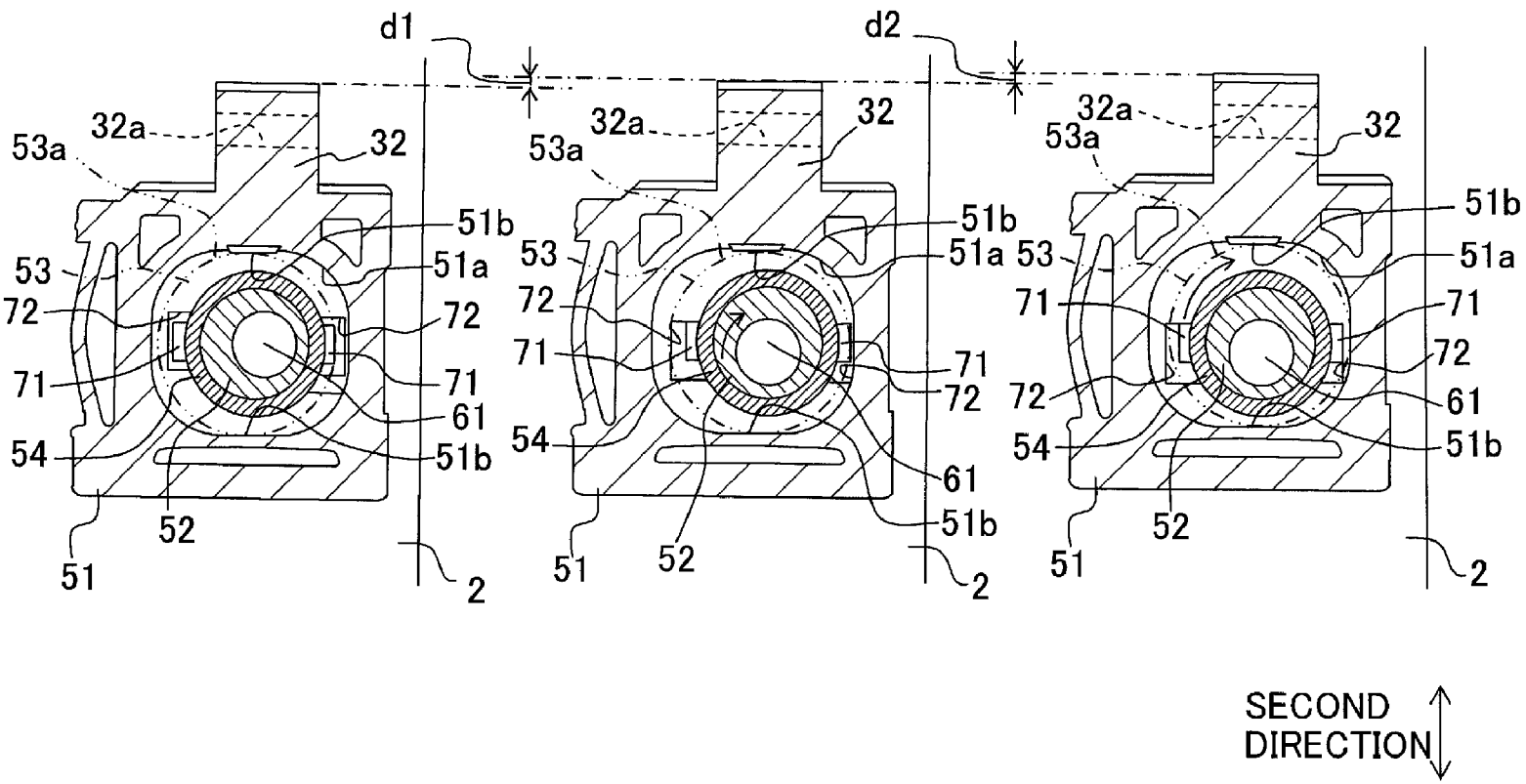
FIGS. 8A to 8C are views corresponding to FIGS. 5A to 5C respectively in accordance with a first modification.

For example, in a modification (a first modification) as shown in FIGS. 8A to 8C, a movement restriction portion 71 is provided on both end portions of the rotation stop member 54 in a direction perpendicular to the second direction to have the same shape as the rotation restriction portion 54*b* has (see FIGS. 6A to 6C) and, meanwhile, grooves 72 similar to the groove 63 are formed in the carriage 2 at the position overlapping each of the movement restriction portions 71, which are inserted into the grooves 72.

In this case, if the inner eccentric cam 52 is rotated, as shown in FIG. 8B, the rotation stop member 54 moves almost parallel to the second direction and, along with this, the movement restriction portions 71 move in the second direction along the width direction of the grooves 72. Further, in this case, the two movement restriction portions 71 come in contact with the wall surfaces of the grooves 72 to restrict the rotation stop member 54 from moving farther.

However, in this case, because the two movement restriction portions 71 are freely movable inside the grooves 72, in comparison with the case of the shaft portion 54*a* inserted through the through hole 62 like the above embodiment, backlash is more likely to occur in the rotation stop member 54.

Further, in the above embodiment, the eccentric cams 52 and 53 and the rotation stop member 54 are arranged inside the through hole 51*a* formed in the slider 51, and both end portions of the outer circumferential surface 53*a* of the outer eccentric cam 53 in the second direction are in contact with the wall surface of the through hole 51*a*. However, the configuration is not limited to this, and it is also possible that only one end portion of the outer circumferential surface 53*a* is in contact with the slider 51 in the second direction.

Figure 9B:
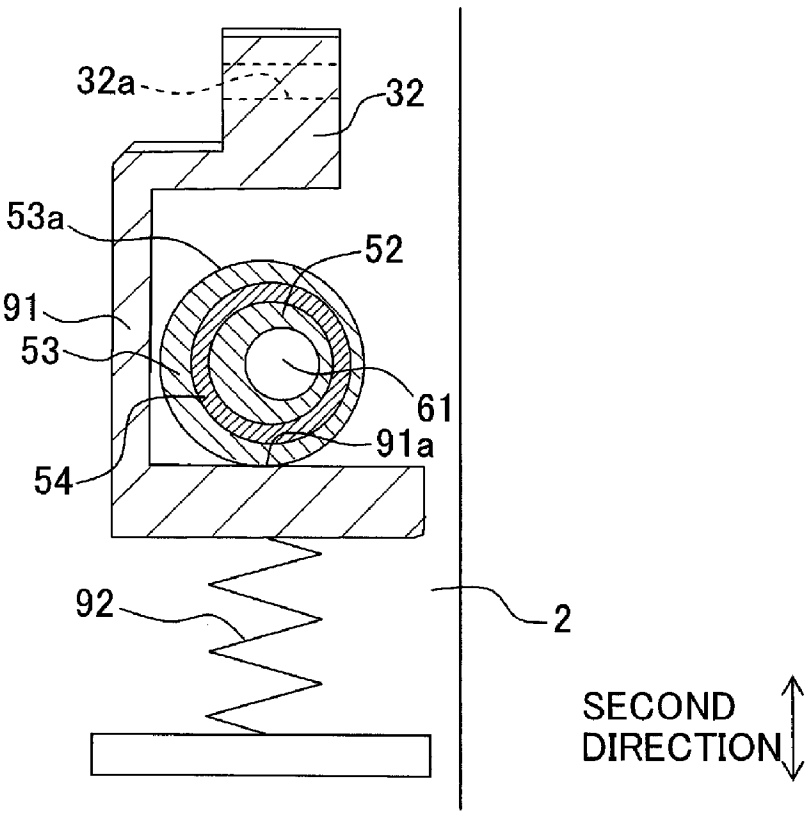
FIGS. 9A and 9B are views corresponding to FIG. 5A in accordance with second and third modifications respectively.
Figure 9A:
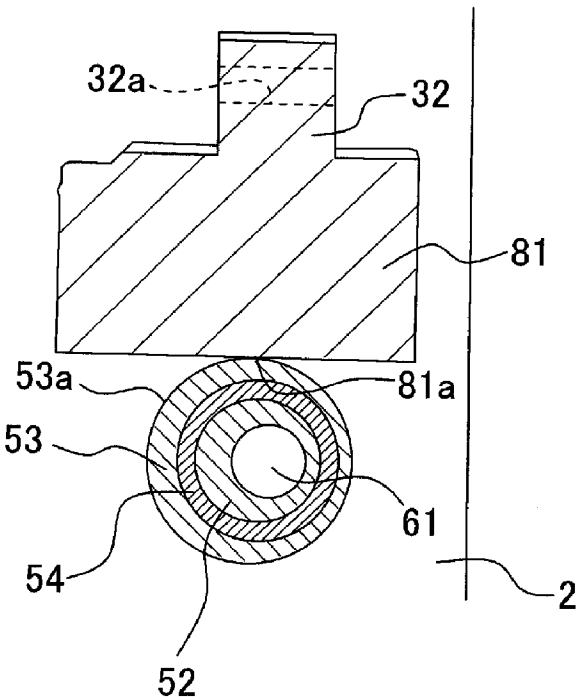

For example, in another modification (a second modification) as shown in FIG. 9A, the eccentric cams 52 and 53 and the like are arranged to be adjacent to a slider 81 on the opposite side to the movable slide member 32 in the second direction, and only the end portion of the outer circumferential surface 53*a* of the outer eccentric cam 53 on the upper side in FIG. 9A is in contact with a contact surface 81*a* which is the surface of the slider 81 on the lower side in FIG. 9A.

Further, in still another modification (a third modification) as shown in FIG. 9B, a slider 91 extends as if to wrap around the eccentric cams 52 and 53 and the like up to the opposite side to the movable slide member 32 across the eccentric cams 52 and 53 and the like in the second direction, and a contact surface 91*a*, which is the upper surface of the portion of the slider 91 on the opposite side to the movable slide member 32 in FIG. 9B, is in contact with the lower end portion of the outer circumferential surface 53*a* of the outer eccentric cam 53 in FIG. 9B. Further, in this case, the carriage 2 is provided with a spring 92 for biasing the slider 91 toward the upper side of FIG. 9B.

Here, as described hereinbefore, because the biasing mechanisms 33 press the slide surface 32*a* against the guide surface 21*a*, the movable slide member 32 and slider 91 tend to move downward in FIG. 9B, that is, the contact surface 91*a* tends to move away from the outer circumferential surface 53*a* of the eccentric cam 53, due to the force to press the slide surface 32*a* back from the guide surface 21*a*. Therefore, in the third modification, the spring 92 biases the slider 91 to press the contact surface 91*a*, which tends to move away from the outer circumferential surface 53*a*, against the outer circumferential surface 53*a*.

Further, in the above embodiment, the two eccentric cams 52 and 53 and the rotation stop member 54 are all circular. However, they are not limited to this.

Figure 10B:
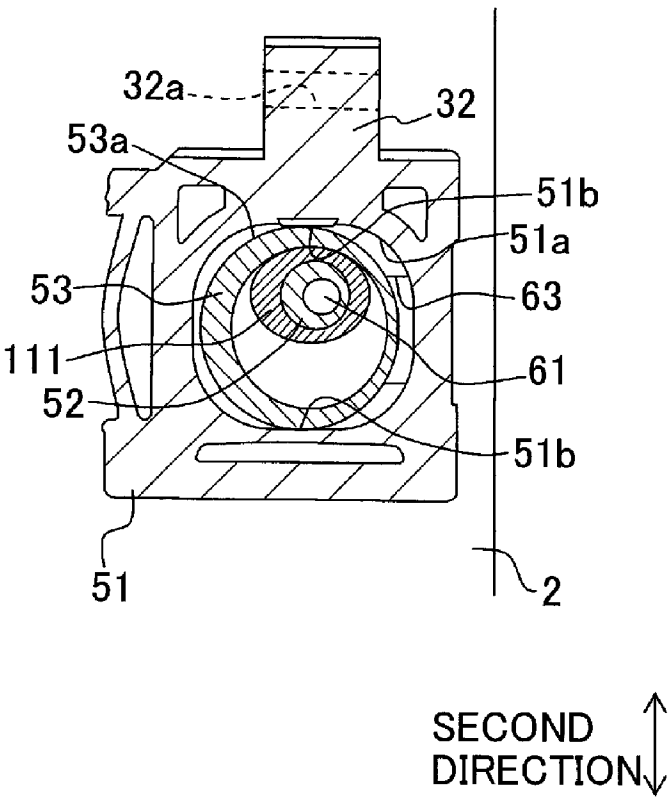
FIGS. 10A and 10B are views corresponding to FIG. 5A in accordance with fourth and fifth modifications respectively.
Figure 10A:
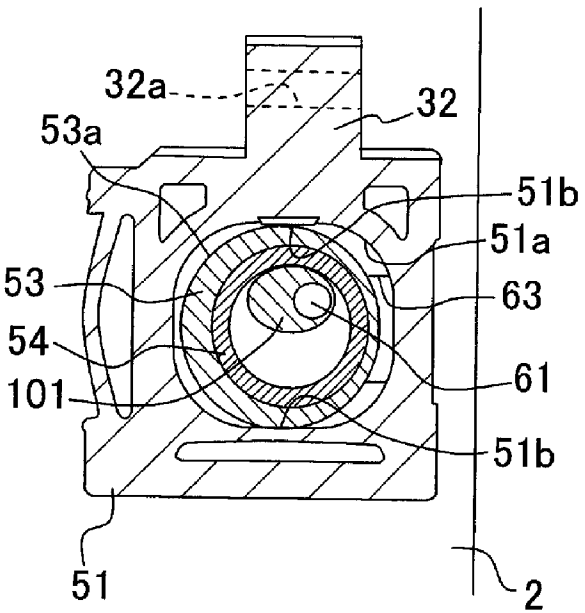

For example, in still another modification (a fourth modification) as shown in FIG. 10A, an elliptical eccentric cam 101 is provided instead of the inner eccentric cam 52 (see FIGS. 5A to 5C). Further, in still another modification (a fifth modification) as shown in FIG. 10B, a rotation stop member 111 is provided instead of the rotation stop member 54 (see FIGS. 5A to 5C) and inner circumference of the rotation stop member 111 is circular, while outer circumference of the rotation stop member 111 is elliptical. Further, in the cases of the fourth and fifth modifications, the rotation shaft 61 is positioned nearer to the movable slide member 32 than it is in the case of the above embodiment in the second direction.

Further, in the above examples, the outer circumferential surface 53*a* of the eccentric cam 53 is directly in contact with the slider, that is, the slider has a contact surface for contact with the outer circumferential surface 53*a* of the eccentric cam 53. However, being not limited to this, it may also be configured such that another member or mechanism may intervene between the slider and the end portion of the outer circumferential surface 53*a* of the eccentric cam 53 in the second direction to move the slider in the second direction by the outer circumferential surface 53*a* of the eccentric cam 53 via that member or mechanism.

Further, in the above embodiment, because the projections 55*a* formed on the plate spring 55 are selectively engageable with any of the plurality of grooves 53*c* formed in the dial portion 53*b*, it is possible to selectively position the eccentric cam 53 to any of the plurality of positions associated with the plurality of grooves 53*c*. However, the positioning mechanism for positioning the eccentric cam 53 is not limited to this, and may be configured in another manner to make it possible to position the eccentric cam 53. For example, projections are formed on the portions where the grooves 53*c* of the dial portion 53*b* were formed and, meanwhile, grooves are formed in the portions where the projections 55*a* of the plate spring 55 were formed; projections and grooves are formed at the inner circumferential surface of the eccentric cam 53 and the outer circumferential surface of the rotation stop member 54 to engage with each other along the circumferential direction; or the like.

Further, the eccentric cam 53 may as well not be provided with such a configuration for carrying out positioning as described hereinabove, and may be configured to be stoppable at any position within the rotation range. For example, it may also be positioned by the frictional force between the outer circumferential surface 53*a* of the eccentric cam 53 and the contact surface 51*b* of the slider 51, or by fixing the eccentric cam 53 to the slider 51 with an adhesive or the like. Even in these cases, if the eccentricity of the eccentric cam 53 is reduced, the moving amount of the slider 51 becomes smaller with respect to the rotational angle of the eccentric cam 53. Thereby, it becomes easy to carry out the operation of rotating the operation portion 53*d* at the time of finely adjusting the movable slide member 32.

Further, in the above embodiment, it is possible to position the eccentric cam 52 to totally three places: the position shown in FIG. 5A, the position after turning 90-degree therefrom clockwise, and the position after turning 90-degree therefrom counterclockwise. However, the eccentric cam 52 may also be provided with similar grooves and projections to those for the eccentric cam 53 to carry out positioning.

Further, in the above embodiment, the rotation shaft of the eccentric cams 52 and 53 (the rotation shaft 61 as well as the central axis of the rotation stop member 54) extends in a vertical direction perpendicular to the jetting surface 5*a*. However, being not limited to this, the rotation shaft of the eccentric cams 52 and 53 may also extend in directions perpendicular to the second direction other than the vertical direction such as in a direction parallel to the jetting surface 5*a* and perpendicular to the second direction.

Further, in the above embodiment, the rotation stop member 54 surrounds the entire circumference of the eccentric cam 52. However, it is not limited to this, and may also be configured in other manners such as to arrange only a part of the portion surrounding the eccentric cam 52, etc., as long as it is possible to prevent one of the eccentric cams 52 and 53 from rotating along with a rotation of the other of the eccentric cams 52 and 53.

Further, in the above embodiment, the angle change mechanism 34 is provided with the two nested eccentric cams 52 and 53 and, meanwhile, the rotation stop member 54 intervenes between the eccentric cam 52 and the eccentric cam 53. However, the number of eccentric cams is not limited to two, but three or more nested eccentric cams may be provided and, meanwhile, a rotation stop member may intervene between every two eccentric cams.

Further, the above explanations were made with respect to examples of applying the present invention to a printer carrying out printing by jetting ink droplets from nozzles. However, without being limited to this, it is also possible to apply the present invention to liquid droplet jetting apparatuses jetting liquid droplets other than ink droplets from nozzles.

What is claimed is:

1. A liquid droplet jetting apparatus which jets liquid droplets, the apparatus comprising:

a liquid droplet jetting head which has a jetting surface in which a plurality of nozzles for jetting the liquid droplets are formed;

a carriage on which the liquid droplet jetting head is installed and which reciprocatingly moves in a first direction along a surface parallel to the jetting surface; and a guide member which has a guide surface perpendicular to the jetting surface and extending in the first direction and which guides the carriage along the guide surface, wherein the carriage is provided with a fixed slide member which is fixed to the carriage and slides along the guide surface, a movable slide member which is arranged apart from the fixed slide member in the first direction and slides along the guide surface and configured to be movable with respect to the carriage in a second direction perpendicular to the first direction, and an angle change mechanism for changing an angle of the carriage with respect to the first direction by moving the movable slide member in the second direction and adjusting a positional relationship between the fixed slide member and the movable slide member, the angle change mechanism has an inner eccentric cam and an outer eccentric cam rotatable around a rotation shaft extending in an extending direction perpendicular to the second direction, and a rotation stop member intervening between the inner eccentric cam and the outer eccentric cam to prevent one of the inner eccentric cam and the outer eccentric cam from being rotated along with a rotation of the other of the inner eccentric cam and the outer eccentric cam, and the inner eccentric cam is nested inside the outer eccentric cam.

2. The liquid droplet jetting apparatus according to claim 1, wherein the movable slide member has a movement member to be moved in the second direction by an outer circumferential surface of the outer eccentric cam.

3. The liquid droplet jetting apparatus according to claim 1, wherein an eccentricity of the inner eccentric cam is greater than an eccentricity of the outer eccentric cam.

4. The liquid droplet jetting apparatus according to claim 1, wherein the extending direction of the rotation shaft is perpendicular to the first direction and the second direction.

5. The liquid droplet jetting apparatus according to claim 1, wherein an outer circumferential surface of the inner eccentric cam has a circular shape.

6. The liquid droplet jetting apparatus according to claim 1, wherein an inner circumferential surface of the outer eccentric cam has a circular shape.

7. The liquid droplet jetting apparatus according to claim 1, wherein each of an outer circumferential surface and an inner circumferential surface of the rotation stop member has a circular shape.

8. The liquid droplet jetting apparatus according to claim 1, wherein the rotation shaft extends in a direction perpendicular to the jetting surface.

9. The liquid droplet jetting apparatus according to claim 2, wherein the movement member has a contact surface which contacts with an end portion of the outer circumferential surface of the outer eccentric cam in the second direction.

10. The liquid droplet jetting apparatus according to claim 1, wherein the carriage is further provided with a biasing member intervening between the carriage and the guide member to bias the carriage toward a direction in which the fixed slide member and the movable slide member are pressed against the guide surface.

11. The liquid droplet jetting apparatus according to claim 1, wherein on the rotation stop member, a cylindrical shaft portion is provided to extend parallel to the rotation shaft; and in the carriage, an accommodation portion which swingably supports the rotation stop member by accommodating the shaft therein.

12. The liquid droplet jetting apparatus according to claim 11, wherein a rotation restriction portion which is in contact with the carriage and restricts a rotation range of the rotation stop member is provided to the rotation stop member on the opposite side to the shaft with respect to the inner eccentric cam.

13. The liquid droplet jetting apparatus according to claim 1, further comprising a positioning mechanism which selectively positions each of the inner eccentric cam and the outer eccentric cam to a position among a plurality of positions within a rotation range.

14. The liquid droplet jetting apparatus according to claim 13, wherein the positioning mechanism has a plurality of grooves provided in each of the inner eccentric cam and the outer eccentric cam to align along a circumferential direction of each of the inner eccentric cam and the outer eccentric cam in correspondence with the plurality of positions, and a projection which is fixed to the carriage and selectively engages with any one of the grooves.

* * * * *